US005310171A

United States Patent [19]

Honma et al.

[11] Patent Number: 5,310,171

[45] Date of Patent: May 10, 1994

[54] COLLATING DEVICE

[75] Inventors: Tomio Honma; Hideo Tanaka, both of Komae, Japan

[73] Assignee: Duplo Corporation, Tokyo, Japan

[21] Appl. No.: 19,292

[22] Filed: Feb. 18, 1993

[30] Foreign Application Priority Data

Feb. 18, 1992 [JP] Japan ..... 4-031102

[51] Int. Cl.[5] ..... B65H 3/44; B65H 5/26

[52] U.S. Cl. ..... 271/9; 271/11; 271/30.1; 271/107

[58] Field of Search ..... 271/5, 9, 11, 30.1, 271/105, 107, 273

[56] References Cited

U.S. PATENT DOCUMENTS 3,004,758 10/1961 Mestre .
3,425,682 2/1969 Pekovsky .
3,730,516 5/1973 Debray .
3,865,364 2/1975 Sterner ..... 271/105
4,049,257 9/1977 Frystak .
4,480,826 11/1984 Kaneko .
4,930,763 6/1990 Horii et al. .
5,041,879 8/1991 Akao et al. ..... 271/11
5,052,672 10/1991 Horii ..... 271/11
5,127,645 7/1992 Torisawa ..... 271/11

FOREIGN PATENT DOCUMENTS 0417868 3/1991 European Pat. Off. .

*Primary Examiner*—H. Grant Skaggs
*Attorney, Agent, or Firm*—Oblon, Spivak, McClelland, Maier & Neustadt

[57] ABSTRACT

The collating device sucks up the topmost sheet of the paper stack on the paper table by the suction head and feeds forward the sheet one after another. The paper table is being given an upward force by a spring. This paper table moves up to the position where the topmost sheet of the paper stack on the paper table contacts with a stopper. This stopper moves up during the period when the suction head feeds forward the topmost sheet. At this time, an electromagnetic brake is set at the on-state and fixes the position of the paper table. The suction head, stopper, electromagnetic brake and the like rotate at the predetermined timing based on the rotation of cams. Thus, according to this invention it is possible not only to save the cost of the device but also to operate the device at high speed.

18 Claims, 8 Drawing Sheets

COLLATING DEVICE

BACKGROUND OF THE INVENTION

1. Field of the Invention

The present invention relates to a collating device which feeds sheets of paper one after another in a printing machine, book-binding machine and the like, more particularly to a suction type sheet feeder which feeds a sheet continuously one after another from the topmost of a stack of papers on a paper table in said printing machine, book-binding machine and the like by sucking a sheet of paper using a suction head.

2. Description of the Prior Art

The sheet feeder of this type in collating device of prior art is constructed so that the topmost sheet of a stack of papers on a paper table is sucked up by a suction head and then the sheet of paper sucked thereby is fed forward by getting nipped between a pair of feed rollers, for example.

In this type of collating device, the top level of the stack of paper must be maintained always at the same height by gradually raising the paper table during the feeding of paper in order to assure the sucking up of the topmost sheet from the paper stack by the suction head. For this purpose, in the ordinary collating device generally the paper table is allowed to drive upwards and downwards by a motor and a sensor is provided to the device to monitor the topmost level of the paper stack so that the drive of said motor is controlled by a control unit based on the output of this sensor to maintain the topmost level of the paper stack at the predetermined position.

However, in case of the prior collating device having a multiple paper tables, each paper table must be provided with each sensor, motor and the like, resulting in increase of cost for the device.

To solve this problem, a collating device provided with a mechanism having springs biasing the paper table upwards, a stopper contacting with the topmost sheet of the paper stack as well as a latch and a ratchet claw and the like inhibiting sliding of said paper table to maintain the topmost level of the paper stack at the predetermined position has been proposed (U.S. Pat. No. 4,930,763).

However, the device disclosed in the prior art has a disadvantage that it can not be operated in high speed because the sliding of paper table is controlled through a ring mechanism which is not suitable for such high speed operation and because the ratchet claw can not follow such high speed operation.

Another device provided with a mechanism to maintain the topmost level of the paper stack at the predetermined position by a detection bar contacting on the topmost sheet of the paper stack, a cam, an one-way clutch and the like has been also proposed as a paper feeding device without using a sensor and a motor for raising the level of the paper table U.S. Pat. No. 4,480,826). However, such device disclosed in this patent is not sufficient in effect to reduce the cost of device.

While, in the book-binding operation any papers having a special quality such as coated papers, art papers and thick papers particularly with a bigger sheet sizes and weights (gsm) must be fed forward accurately a paper one after another, therefore the suction type collating device is suitable for this type of use.

However, the suction type collating device used for the book-binding operation has a narrower space between the paper tables allowing to load only a limited volume of papers on one table because it is generally consisted with multi-layer paper tables. Moreover, the bigger the size of paper (gsm), the fewer the number of sheets to be loaded. Therefore, in case bigger size (gsm) of sheets is fed, because feeding is completed within a short time, an operator must add new sheets continuously to the empty table.

In the prior art ordinary collating device, the device itself is programmed to stop its operation to prevent any missing page when the paper table is emptied. Therefore, even though only one table is emptied, the whole machine has to be stopped during which new sheets have to be placed on the paper table, resulting in a longer loading work than the actual operation of the device.

SUMMARY OF THE INVENTION

It is an object of the present invention to provide a collating device which can save the cost of the device and can be operated at high speed.

The collating device according to the present invention feeds a sheet of paper on the topmost of paper stack one after another. The device comprises a paper table loaded with said paper stack; support means for supporting this paper table so as to be able to move up and down; biasing means for biasing the paper table upward; a stopper which can move between the first position at which the topmost sheet of said paper stack contacts with and the second position separating from said paper stack, fixing means for fixing the position of said paper table at the on-state and to release the paper table to free state at the off-state, a suction head which can suck up each sheet by sucking force, suction head moving means for moving said suction head between the lower position where the topmost sheet of said paper stack is sucked up and the upper position where the suction head is separated from said paper stack, and control means for controlling operations of said stopper, fixing means, suction head and suction head moving means.

In this invention, the paper table is always given an upward force by said biasing means. And, this paper table is inhibited to move upwards by the stopper contacting with the topmost sheet of the paper stack loaded on the paper table. This stopper is controlled by the control means and allowed to move between the first position inhibiting the upward movement of said paper table and the second position separating from said sheet stack. Said control means works to inhibit the movement of the paper table by control of the electromagnetic brake and the like and at the same time to transfer said stopper to the second position to avoid the feeding forward of a sheet being disturbed by the stopper. Therefore, the topmost sheet can be smoothly fed forward by the suction head.

After completion of feeding forward of the first sheet, said control means transfers said stopper to the first (lower) position and releases the electromagnetic brake. The paper table thereby is pushed upwards by said biasing means or spring till the topmost sheet (the second sheet) of the paper stack contacts with said stopper. Consequently, this action is repeated to feed forward the next sheet.

Thus, the collating device according to the present invention repeats the up and down movement of the stopper and the drive and release of the electromagnetic brake (on-off of the fixing means) every time feeding forward of sheet to maintain the topmost level of the paper stack at the predetermined position.

According to the present invention, it is possible to save the device cost because the paper table is moved up by using the spring as mentioned above. The device can be operated in high speed because a link mechanism is not used for the position control of the paper table and the movement of the paper table is controlled by the electromagnetic brake.

DETAILED DESCRIPTION OF THE PREFERRED EMBODIMENTS

Figure 1:
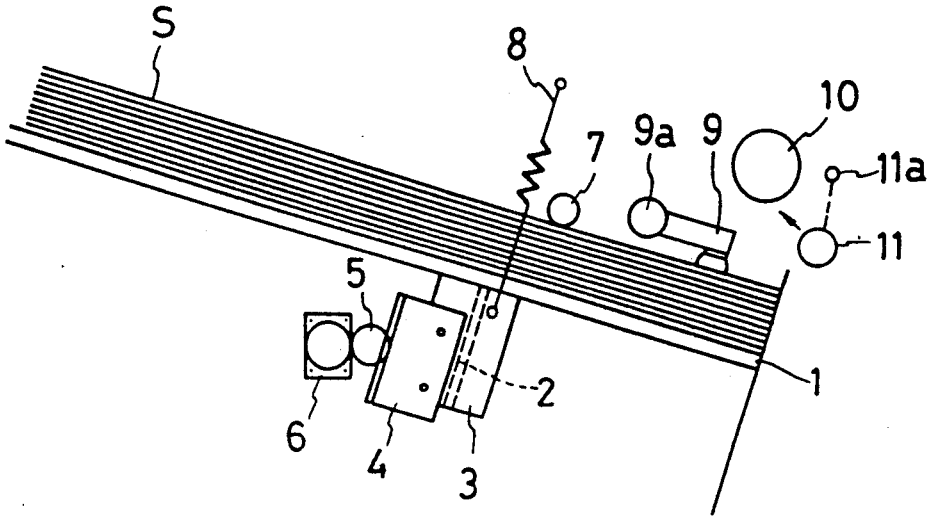
FIG. 1 is a schematic diagram showing the sheet feeder of the collating device according to an embodiment of the present invention.
Figure 2:
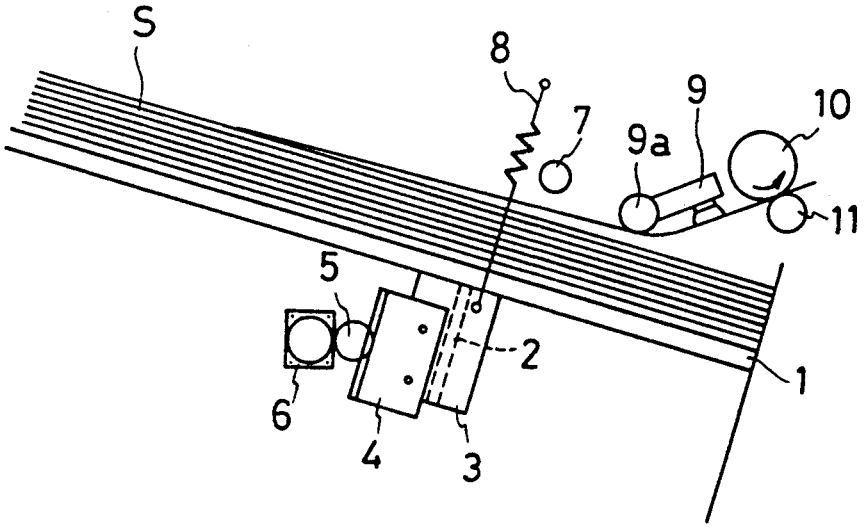
FIG. 2 is a schematic diagram showing the sheet feeder of the collating device of the present embodiment.
Figure 3:
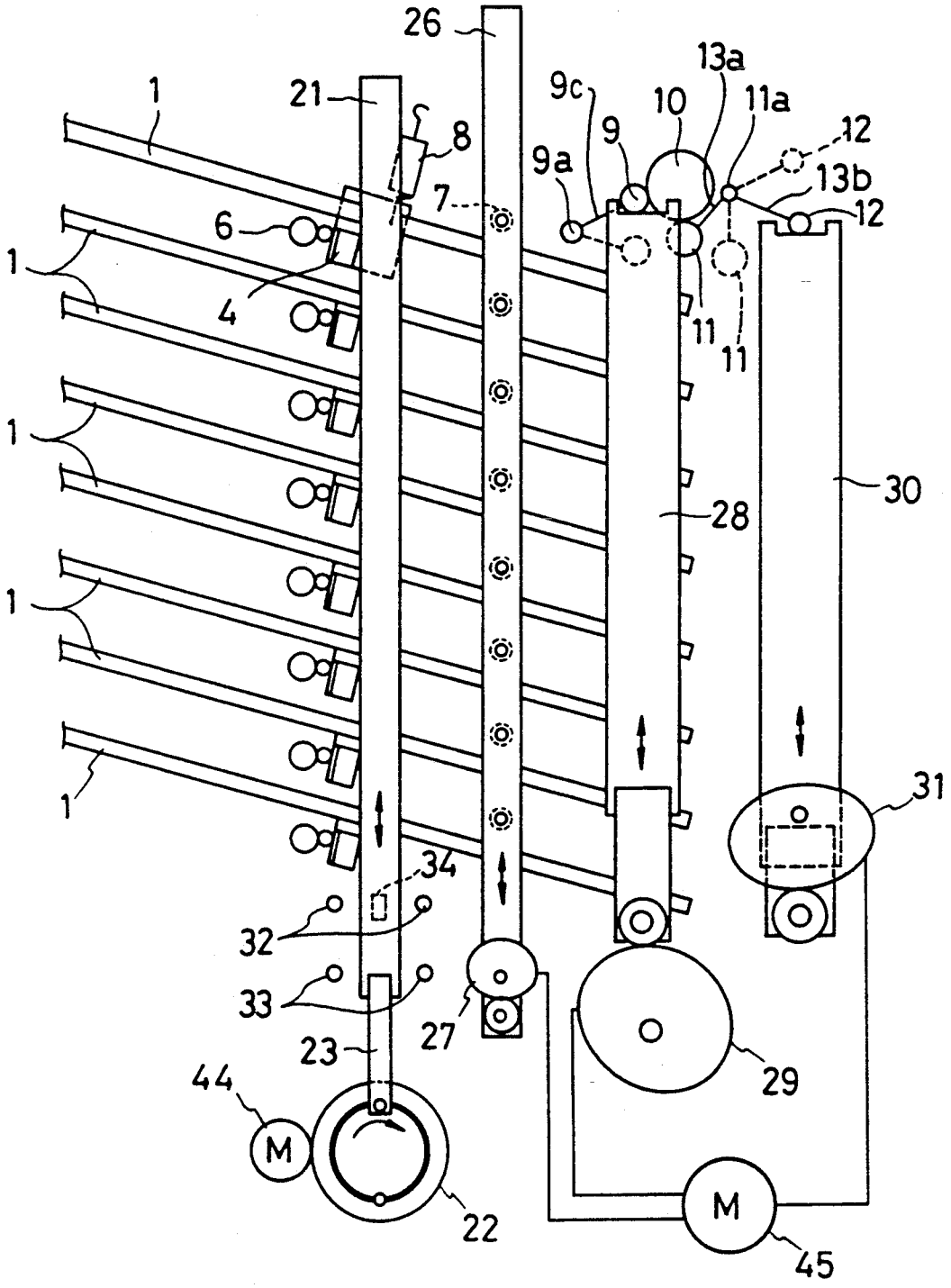
FIG. 3 is a schematic diagram showing the collating device of the present embodiment.

Then, the preferred embodiment of this invention will explained in detail referring drawings attached. The sheet feeder of the collating device according to the embodiment of the present invention will be explained first. FIGS. 1 and 2 are drawings showing the construction of the paper table and FIG. 3 is a drawing showing the collating device provided with this paper table. As shown in FIG. 3, multiple paper tables 1 (8 tables in this drawing) are provided to the main body of the collating device. As shown in FIGS. 1 and 2, a table support shaft 2 is fixed to the main body of the collating device at slight angle with respect to the vertical direction in each paper table 1. To the back of each paper table 1, a support member 3 is fixed and this support member 3 engages the table support shaft 2. According to sliding of the support member 3 along the support shaft 2, the paper table 1 can slide up and down in the direction along the table support shaft 2.

And, a spring 8 is provided for each paper table 1, and fixed on its one end to the main body of the collating device and on another end to the support member 3. By this spring 8, this paper table 1 is always given an upward force.

A cam lever 21 extending in the vertical direction is provided so that it engages all paper tables 1. The lever 21 is also given the upward force by the spring 8 through the paper table 1. The lower end of this cam lever 21 is connected to a cam 22 through a connecting shaft 23 and the cam 22 is driven by a motor 44 so that if the motor 44 rotates and the lever 21 is pushed up to the upper position by the cam 22, each paper table 1 can move up to the upper position, resulting in the operation mode. On the other hand, if the lever 21 is pulled down to the lower position, each paper table 1 simultaneously moves down, resulting in the standstill mode of sheet feeding and allowing to supply sheets to the paper table 1.

A sensor 32 detecting the topmost level of the lever 21 and a sensor 33 detecting the bottommost level of the lever 21 are provided nearby this lever 21. Each of the sensors 32, 33 has a light-emitting element and a light-detecting element. The lever 21 is provided with a member 34 which can shut the light emitted by said light-emitting element so that said light-detecting element detects the turning off of the light from said light-emitting element, when the member 34 enters into the region between said light-emitting element and said light-detecting element.

A stopper 7 is provided for each paper table 1. These stoppers 7 are the rod-like members elongating in the direction of the width of the paper table 1 and are mounted on a stopper lever 26 extending in a vertical direction. Once this stopper 7 contacts with the topmost sheet of a paper stack S placed on the paper table 1, the paper table 1 is inhibited to slide up further. This stopper lever 26 is driven by the rotation of a cam 27 and can slide between the first position inhibiting the movement of the paper table 1 when contacted with the paper stack S and the second position separated from the paper stack S as shown in FIG. 2.

Figure 8:
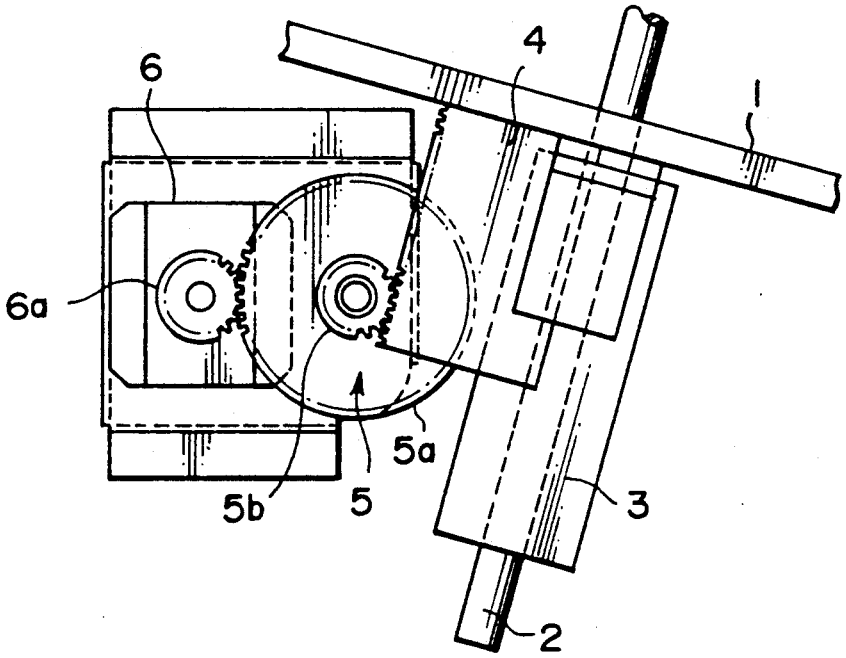
FIG. 8 depicts a gearing arrangement for an electromagnetic brake utilized for the rack fixed tot he support member of the paper table of the present invention.

A rack 4 is fixed to the support member 3. This rack 4 is connected to an electromagnetic brake 6 through a gear member 5. As shown in FIG. 8, the gear member 5 has two gears 5*a* and 5*b*, one larger size gear 5*a* and one smaller size gear 5*b*, which are fixed on the same rotation axis, with the larger size gear 5*a* engaging a gear 6*a* on the electromagnetic brakes 6 and with the smaller gear 5*b* engaging the rack 4. A controller 40 (see FIG. 4) controls this electromagnetic brake 6 based on the rotation of the cam 22 and the cams 27, 29, 31 so that if the electromagnetic brake 6 is at the on-state, the movement of the paper table 1 is inhibited and if it is at the off-state, the movement of the paper table 1 is not inhibited.

On the other hand, a suction head 9 is provided over each paper table 1 and can fluctuate centering around rotation axis or rotation shaft 9*a*. The suction head 9 and the suction head rotation shaft 9*a* are connected with each other by a suction head rod 9*c*. This suction head 9 is connected to a suction device (not shown in drawings) and the apex of the head (pad) sucks up a sheet once negative pressure is given. Each suction head 9 engages a suction head lever 28 which moves up and down according to the rotation of a cam 29.

A sheet feed roller 10 and a nip roller 11 are provided at the downstream of sheet flow from each suction head 9. In FIG. 3, both sheet feed roller and nip roller are indicated only for the topmost paper table 1. The sheet feed roller 10 is fixed at the same position and rotates by a drive circuit 46 (see FIG. 3). The nip roller 11 is provided so as to be able to fluctuate around an axis or nip roller rotation shaft 11*a*. A pair of levers or nip roller rods 13*a* and 13*b* are fixed to this axis 11*a* with an angle constituted by the levers or rods 13*a* and 13*b* fixed. The nip roller 11 is provided at the tip of the lever 13*a* and a weight roller 12 is provided at the tip of the lever 13*b*. The weight roller 12 is heavier than the nip roller 11 and this difference of weight pus the nip roller 11 o the surface of the sheet feed roller 10 giving an appropriate snapping pressure between the nip roller 11 and the sheet feed roller 10. A nip roller lever 30 extending in vertical direction is provided so that it moves up and down according to the rotation of a cam 31. The weight roller 12 provided for each paper table 1 (the weight roller only for the topmost paper table is shown in FIG. 3) is supported by the lever 30. When the lever 30 is at the lowest position, the weight roller 12 is released free from the lever 30, so that the nip roller 11 is pushed on the sheet feed roller 10 by the moment of this weight roller 12 and the lever **13*b* and rotated by the sheet feed roller 10. On the other hand, when the lever 30 is at the highest position, the weight roller 12 is pushed up and the nip roller 11 is released from the sheet feed roller 10**.

Figure 9:
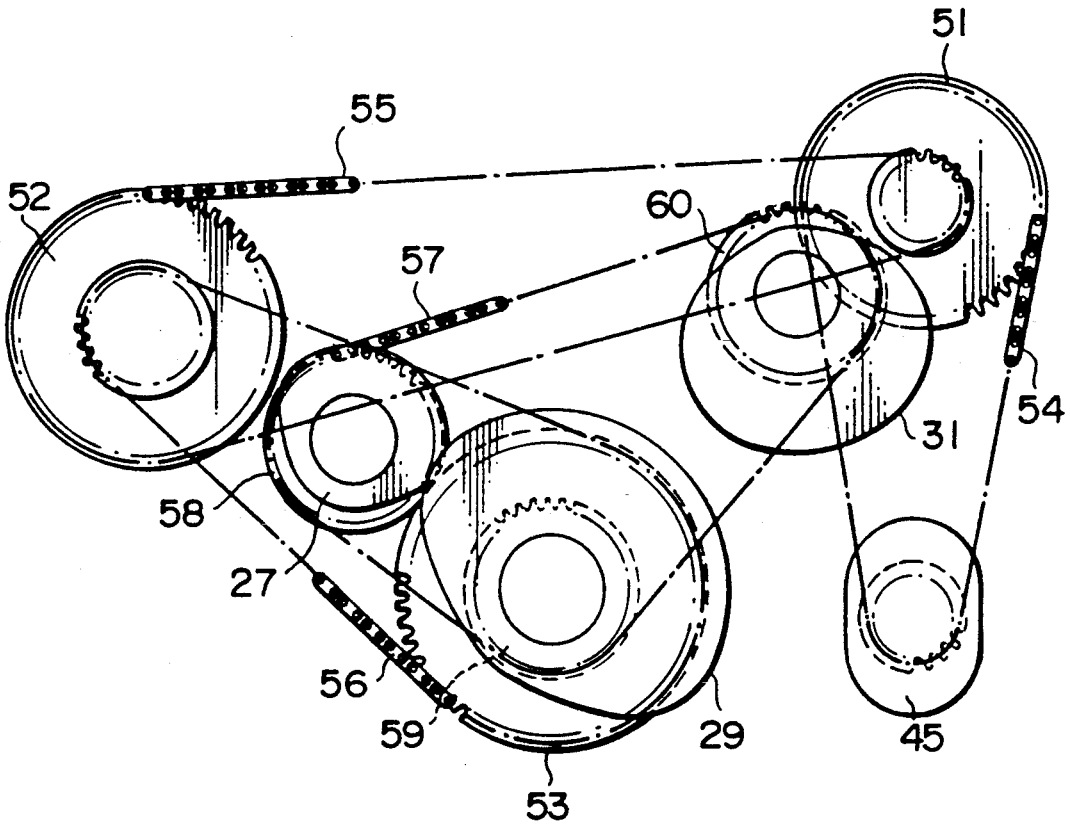
FIG. 9 depicts a chain/cam driving arrangement.

The cam 22 is driven by the motor 44. As shown in FIG. 9, each of the cams 27, 29 and 31 are connected to each other by chains utilizing chain sprocket wheels 58, 59 and 60 which are of the same diameter, and which are coaxially fixed with the cams such that the chain sprocket wheels 58, 59 and 60 can be connected to each other by a chain 57. The motor 45 engages a first reduction gear 51 by a chain 54, and a second reduction gear 52 engages the first reduction gear 51 by a chain 55. The second reduction gear 52 further engages, via chain 56, a chain sprocket wheel 53 which is fixed to the chain sprocket wheel 59 on the same rotation axis. Thus, the rotation of the motor 45 is reduced by each of the first and second reduction gears 51 and 52, and also by the chain sprocket wheel 52 and finally transmitted to the cam 29 resulting in driving of the cam 29 thereby. The cam 29 engages each of the cams 31 and 27 by the chain 57 through the chain sprocket wheels 58, 59, and 60 such that the cams 27, 29 and 31 are synchronized with each other with the same rotation speed by the motor 45, and complete one cycle of their operations for each rotation.

Figure 4:
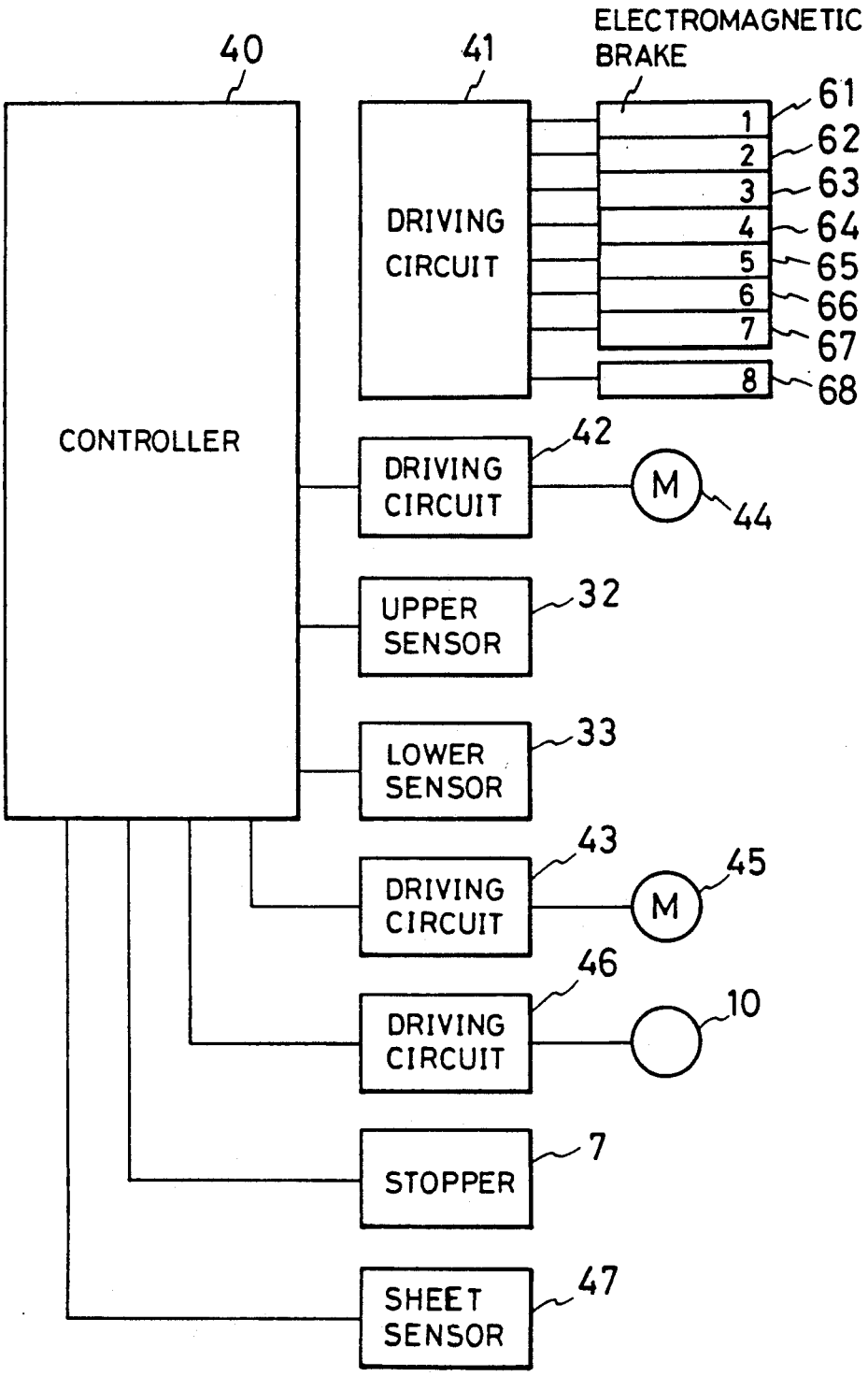
FIG. 4 is a block diagram showing the control means of the embodiment shown in FIG. 3.

FIG. 4 shows a drive control device of said collating device. A controller 40 is connected with eight electromagnetic brakes 61, 62, 63, 64, 65, 66, 67 and 68 through an electromagnetic brake driving circuit 41. The controller 40 is also connected with the motor 44 to drive the cam lever 21 up and down through a motor drive circuit 42 and a motor 45 to drive the levers 26, 28 and 30 up and down through a motor drive circuit 43. Furthermore, the controller 40 is connected with sensors 32 and 33 to detect the topmost and bottommost levels of the cam lever 21 as well as with a sheet feed roller driving circuit 46 to drive the sheet feed roller 10. In addition, output signal from the stopper 7 can be input to the controller 40.

Next, the operation of thus constructed collating device according to this embodiment will be explained.

When the power switch of the device is off, the lever 21 is at the lowest level. Then, if the power switch of the device is turned to on, the device is set at the standby-stage. In the standby-stage, the lever 21 is at the lowest level, thereby the paper table 1 slides down to the lowest position. This situation allows to load the paper stack S on the paper table 1.

At this time, the electromagnetic brake 6 (61–68) is at the off-state, and the stopper 7 is positioned at the first position (lower position).

Then, if the start-button is set at the operational position, the controller 40 drives the motor 44 through the motor drive circuit 42 and moves up the lever 21. When the lever 21 is raised to the uppermost position and each paper table 1 is moved up at the position shown in FIG. 1 and the upper sensor 32 detects the member 34, this output signal is input to the controller 40 and the movement of the lever 21 and the paper table 1 is stopped thereby.

Figure 5:
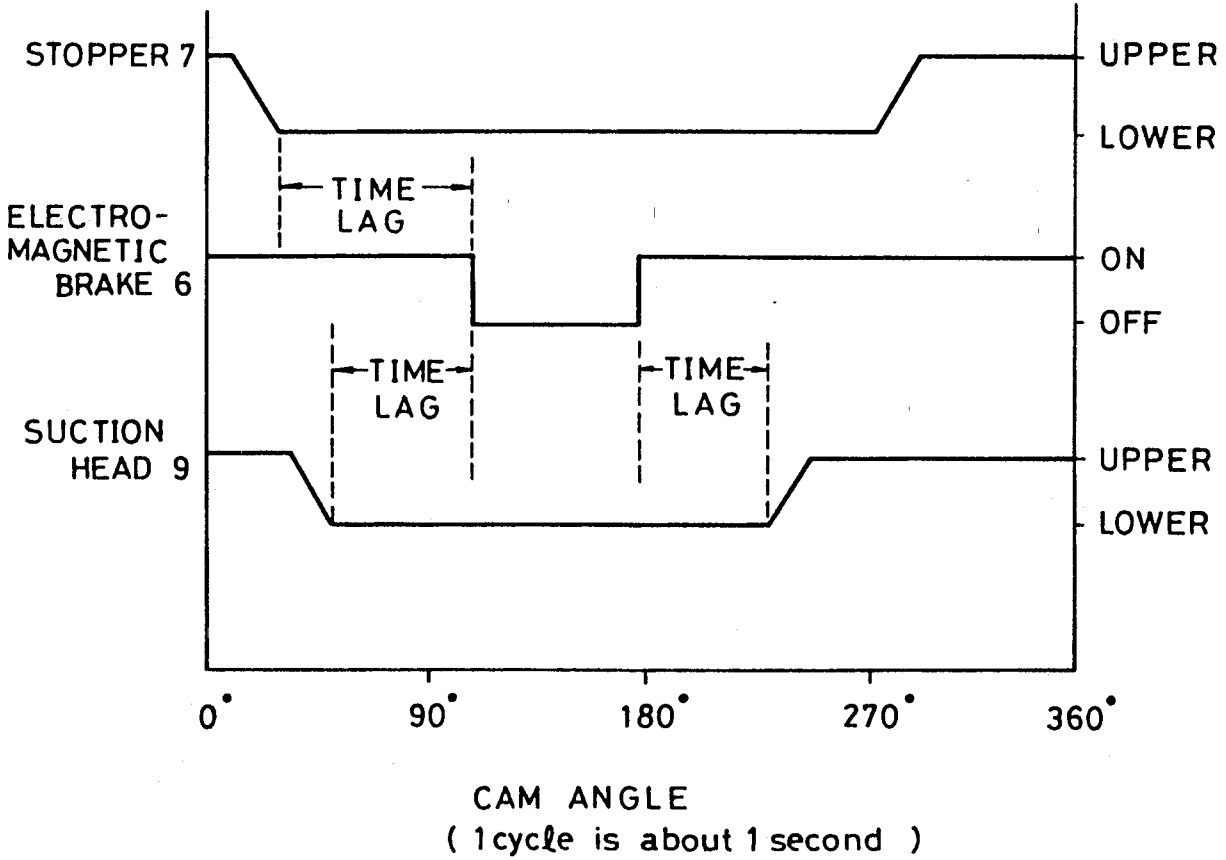
FIG. 5 is a timing chart showing the operations of the stopper, electromagnetic brake and suction head.

Then, the controller 40 drives the motor 45 through the motor drive circuit 43 and the cams 27, 29 and 31 are set at the initial stage (the cam angle is 0°). FIG. 5 is a timing chart showing the relationship between the rotation angle of the cams and the operations of the stopper 7, the electromagnetic brake 6 and the suction head 9. At the initial stage, the stopper 7 is set to the second position (the upper position), the electromagnetic brake 6 is set to the on-state sot hat the paper table 1 is fixed, and the suction head 9 is set to the upper position. After setting all at the initial stage, the controller 40 starts to drive the motor 45 through the motor drive circuit 43. When the cams 27, 29 and 31 rotated up to about 12°, the stopper 7 moves to the first position (lower position).

When the cams rotated up to about 36°, then the suction head 9 moves down. At a certain lag time after the stopper 7 and the suction head 9 completely moved down, the cam angle reaches to about 110°, then the controller 40 releases each electromagnetic brake 6 through the driving circuit 41 to the off-state. Simultaneously, the restriction of the movement of the paper table 1 by the electromagnetic brake 6 is released to the free state, then the paper table 1 moves up till the topmost sheet of paper stack S on the paper table contact with the stopper 7 at the first position. Once the topmost sheet of the paper stack S contact with the topper 7, the movement of the paper table stops and consequently the electromagnetic brake 6 turns to the on-state and fix the position of the paper table 1 thereby.

Then, the suction head 9 sucks up the topmost sheet of the paper stack and turns up to the position shown in FIG. 2. The stopper 7 moves to the second position (upper position) and leaves from the topmost sheet of the paper stack. At the same time, the nip roller 11 moves up to contact with the sheet feed roller 10 and the apex of the sheet sucked up by the suction 9 is nipped between the nip roller 11 and the sheet feed roller 10. Then, the sheet is released to free from the suction head 9 and fed forward by rotation of the sheet feed roller 10.

Then, the cam turns to 0° (the initial stage) and all steps mentioned above are repeated to feed forward the topmost sheet of the paper stack (the second sheet of paper). Thus, the device of this embodiment feeds a sheet of paper from the paper stack S loaded on the paper table 1 sheet by sheet. If a top button is pushed, the controller 40 stops the motor 45 and drives the motor 44 to rotate, then the paper table 1 being slid down to the lowest position.

Next, in case the paper table is emptied, the operation for supply of the paper stack S will be explained as follows. If a sheet of paper is fed forward continuously by utilizing an independent mode from all of each paper table, the paper stack on the one of the eight paper tables is of different page number of sheets from those on the any of the other paper tables. In the independent mode, the operation of a whole machine has to be stopped to supply additional sheets of paper when any of paper table 1 become empty. That is, the motor 44 is driven to push down the cam lever 21, then the paper stack S is loaded on the paper table 1. Thus, in case of the independent mode, the operation of a whole machine must be stopped to supply additional paper stack. However, paper sheets for eight pages can be fed forward from eight layers paper tables.

Figure 7:
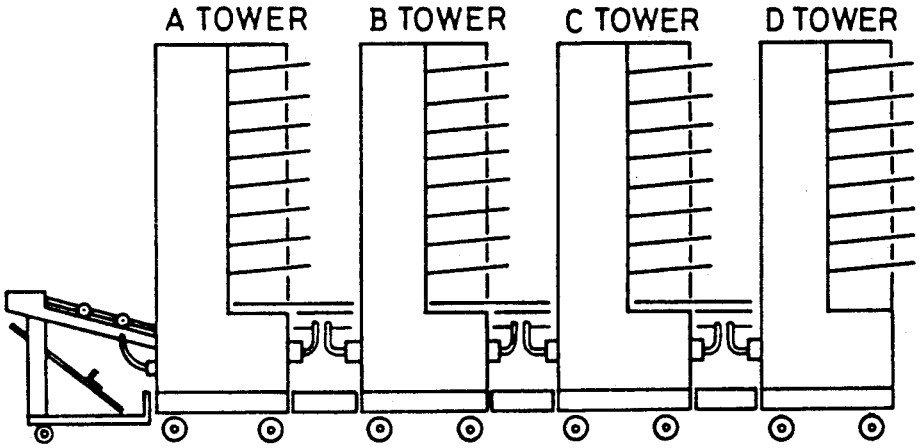
FIG. 7 is a schematic diagram showing the collating device provided with four towers.

As shown in FIG. 3, the collating device has one tower constructed with eight layers paper tables. And, as shown in FIG. 7 for example, if four towers from A to D towers are provided, sheets for eight pages can be fed from one tower, allowing to feed forward continuously for 32 pages by connecting four towers.

However, if the collating device is set at the continuous mode, a paper stack can be fed forward without discontinue of operation. Particularly for paper with thicker paper or heavier unit weight (weight /area), a paper stack on the paper table 1 is consumed very quickly but this device allows to feed forward continuously by supplying sheets of such paper to the paper table 1 time to time without discontinue of operation if the continuous mode is used.

In the continuous mode, two adjoining paper tables in one tower are paired, and a sheet is fed forward only from on of them and another leaves in the standstill state. In this case if four towers are used as shown in FIG. 7, sheets for 16 pages can be fed forward which is fewer than those in case of the independent mode, but there is an advantage that sheets can be fed forward continuously without discontinue of operation.

Next, referring a flow chart shown FIG. 6, the operation of paper stack supply will be explained in detail for case of sheet feeding using this continuous mode. The topmost paper table 1 is referred to as the paper table (1), the next lower paper table 1 as the paper table (2) and so on. The bottommost paper table is referred to as the paper table (8). Two paper tables, the paper table (1) and (2) or (3) and (4) are paired. That is, the odd numbered paper table and the next lower paper table with the even numbered paper table are paired. We assume that a sheet is fed forward from each odd numbered paper table [(1), (3), (5) and (7)] and remaining paper tables having the even number [(2), (4), (6) and (8)] are all in the standstill state.

A sheet sensor 47 (see FIG. 4) is provided to each paper table and made arranged, if this sensor 47 detected the empty of sheet, that the signal is input to the controller 40.

Figure 6:
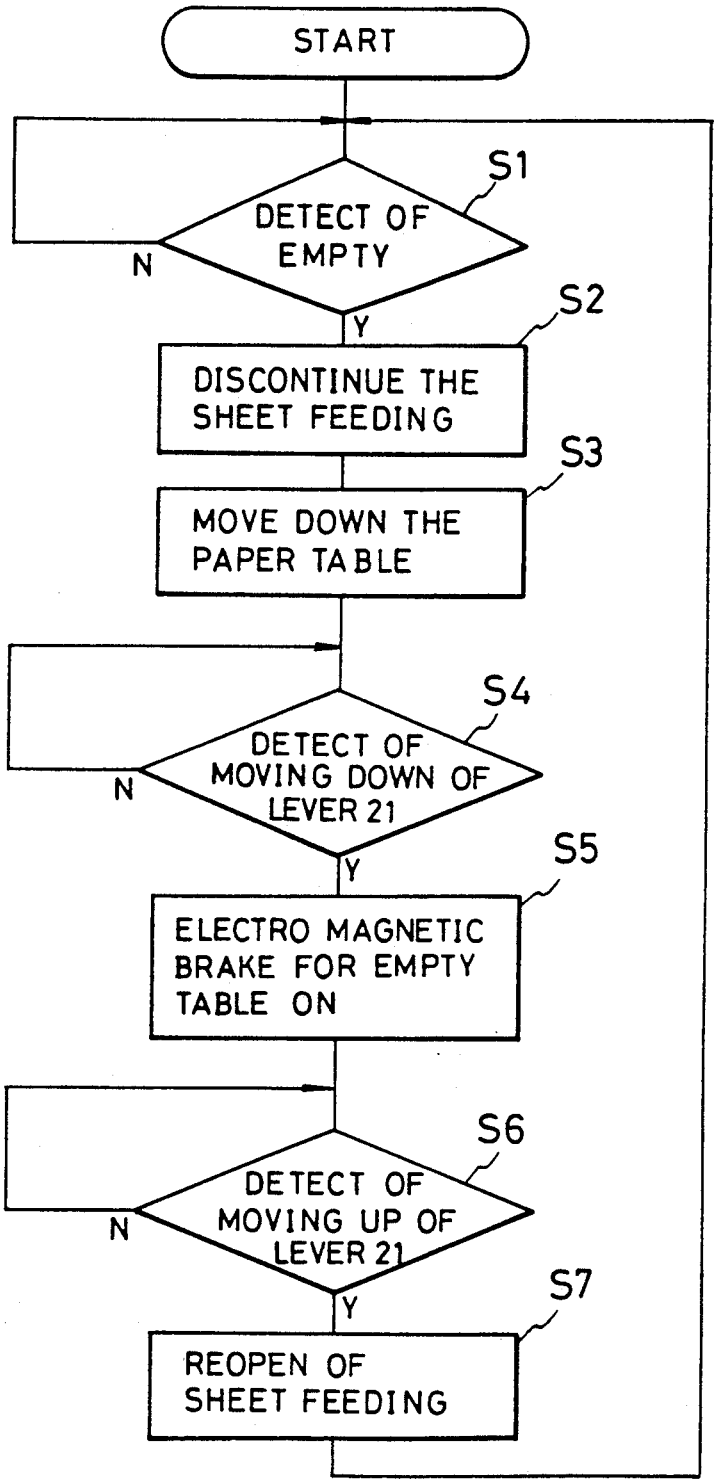
FIG. 6 is a flow chart showing the sheet supplying operation.

First, as shown in FIG. 6, once the signal of this sensor 47 indicating the empty of paper (paper stack) is input to the controller 40 (set S1), the controller 40 stops the rotation of the cams 27, 29 and 31 for all paper table 1 and discontinues the sheet feeding thereby (step S2).

Then, the controller 40 releases the electromagnetic brakes 6 (61–68) provided to all paper tables 1 to the off-state and releases the paper tables 1 to freely movable state, drives the motor 44 at the same time, rotates the cam 22 and pulls down the cam lever 21 (step S3). All paper table 1 move down thereby.

Then, once the sensor 33 detected that the lever 21 moved to the lower position (step S4), the controller 40 turns the electromagnetic brake 6 provided to the paper table from which the empty of sheet was detected to the on-state and fixes the position of and restricts the upward movement of that paper table 1 (step S5).

Because the motor 44 is still rotating, the lever 21 turns to move upwards after passed the lowest position. All paper tables except for paper table 1 being restricted its upward movement by the electromagnetic brake 6 start to move up, and once the cam lever 21 reached to the topmost position, the sensor 32 detects it (step S6).

Following this step, the controller 40 received the detection signal from this sensor 32 starts to drive the motor 45 and reopens the sheet feeding operations by the cams 27, 29 and 31 (step S7).

Because the empty paper table is still staying at the lower position, it is not involved in the sheet feeding operation but the feeding starts from the even numbered paper table of the pair.

In this case, the device is provided with a flushing lump and/or an alarm connected to the sheet sensor, the operator can easily find the empty paper table and supply new sheets to the standstill paper table.

Thus, once the empty of sheet was detected, the electromagnetic brakes 6 of all paper tables are released to the off-state, all paper tables are moved down by the downward movement of the cam lever 21 and the empty paper tables are fixed at the lowest position by setting the electromagnetic brake 6 to the on-state when the paper tables are still at the lowest position, other paper tables are allowed to move up and to start the feeding operation. And, for the empty paper table, another paper table of the pair is used to start the feeding during which time new sheets can be supplied to the empty paper table. All these operation are performed during one cycle of rotation of the cam 22 driven by the motor 44. Therefore, the standstill period of sheet feeding is very short and the collating device can be operated almost continuously.

In this embodiment, the time lag after the electromagnetic brake 6 wa released to the off-state till the paper table 1 reaches to the upper position is set at very short time and only for one cycle. This time lag was provided to avoid any interference between the stopper 7 and the suction head 9 during both are at lower position. Therefore, operation mistake can be eliminated even though the machine is operated at high speed. The off-time of the electromagnetic brake 6 can be further reduced by increasing the elasticity of the spring 8 if necessary. If operation is too slow, it can be adapted by reducing the elasticity of the spring 8.

According to this embodiment, because the paper table is moved by spring, the constitution of the device is simple and the device cost can be reduced. And, because any link mechanism and the like are not used for the position control of the paper table, the device can be operated successfully even at high speed.

As explained above, according to this invention because the paper table is given the upward force by spring and the movement of the paper table is controlled by the stopper and the electromagnetic brake controlled by the control means, the topmost level of the paper stack loaded on the paper table can be maintained at the predetermined position by a relatively simple structure. Therefore, according to the present invention not only the cost of device can be saved but also there is effect that the device can be operated at much higher speed compared to the ordinary devices.

What is claimed is:

1. A collating device for feeding a sheet of paper on the topmost of a paper stack one after another, comprising:

a paper table loaded with said paper stack;

support means for supporting the paper table so as to be able to move up and down;

biasing means for biasing the paper table upward;

a stopper movable between a first position at which the topmost sheet of said paper stack contacts said stopper and a second position at which said stopper is spaced from said paper stack;

fixing means for fixing the position of said paper table in an on-state and for releasing the paper table in an off-state in which said fixing means does not fix the position of the paper table;

a suction head which can suck up each sheet by a sucking force;

suction head moving means for moving said suction head between a lower position where the topmost sheet of said paper stack is sucked up and an upper position where the suction head is separated from said paper stack; and control means for controlling operations of said stopper, fixing means, suction head and suction head moving means.

2. The collating device according to claim 1, wherein said fixing means comprises a rack fixed to said paper table, and an electromagnetic brake connected to said rack.

3. The collating device according to claim 2, wherein said fixing means comprises a first gear provided on said electromagnetic brake, a second gear engaged with said first gear, and a third gear which is smaller than said second gear and engaged with said rack, the second and third gears being fixed with each other coaxially.

4. The collating device according to claim 1, further comprising:

a sheet feed roller;

sheet feed roller driving means for rotating said sheet feed roller;

a nip roller rotated by said sheet feed roller nipping said sheet between the sheet feed roller and the nip roller, thereby sending said sheet forwards; and nip roller moving means for moving said nip roller to a rotating state position where said nip roller rotates with said sheet feed roller and to a position where the nip roller is spaced from said sheet feed roller.

5. The collating device according to claim 4, wherein said control means locates said stopper at the second position, and sets said nip roller at the rotating state position where said nip roller rotates with said sheet feed roller at a initial stage.

6. The collating device according to claim 1, wherein said control means locates said stopper at the second position, sets said fixing means at the on-state, and sets said suction head at the upper position at an initial stage, and said control means locates, in sequence, the stopper at the first position, the suction head at the lower position, sets the fixing means at the off-state, sets the fixing means at the on-state, and locates the suction head at the upper position and the topper at the second position during one cycle of a sheet feed operation.

7. A collating device for feeding a sheet of paper on the topmost of a paper stack one after another, comprising:

multiple paper tables loaded with said paper stack;

support means for supporting the paper tables so as to be able to move up and down;

biasing means for biasing said paper tables upward;

a stopper which is provided for each paper table and which is movable between a fist position at which the topmost sheet of said paper stack contacts said stopper and a second position at which said stopper is spaced from said paper stack;

fixing means, provided for each paper table, for fixing the position of said paper table in an on-state and for releasing the paper table in an off-state in which said fixing means does not fix the position the paper table;

a suction head provided for each paper table which can suck up each sheet by a sucking force;

suction head moving means for moving said suction heads between a lower position where the topmost sheet of said paper stack is sucked up and an upper position where the suction head si separated from said paper stack;

a paper table lever which engages each of said paper tables and which can pulldown said paper tables at one time;

a paper table lever driving means for driving said paper table lever between an upper feeding position and a lower standby position; and control means for controlling operations of said stoppers, fixing means, suction heads, suction head moving means and paper table lever driving means.

8. The collating device according to claim 7, wherein said fixing means comprises a rack fixed to each paper table, and an electromagnetic brake connected to each rack.

9. The collating device according to claim 8, wherein said fixing means comprises a first gear provided an said electromagnetic brake, sa second gear engaged with said first gear, and a third gear which is smaller than said second gear and engaged with said rack, the second and third gears being fixed with each other coaxially.

10. The collating device according to claim 7, further comprising:

a sheet feed roller provided for each paper table;

sheet feed roller driving means for rotating said sheet feed roller;

a nip roller provided for each paper table and rotated by said sheet feed roller, nipping said sheet between the sheet feed roller and the nip roller, thereby sending said sheet forwards; and nip roller moving means for moving said nip roller to a rotating state position where said nip roller rotates with said sheet feed roller and to a position where the nip roller is spaced from said sheet feed roller.

11. The collating device according to claim 10, wherein said control means locates said stopper at the second position, and sets said nip roller at the rotating state position where said nip roller rotates with said sheet feed roller at an initial stage.

12. The collating device according to claim 7, wherein said control means locates said stopper at the second position, sets said fixing means at the on-state, and sets said suction head at the upper position at an initial stage, and said control means locates, in sequence, the stopper at the first position, the suction head at the lower position, sets the fixing means at the off-state, sets the fixing means at the on-state, and locates the suction head at the upper position and the stopper at the second position during one cycle of a sheet feed operation.

13. The collating device according to claim 7, wherein said control means controls a one cycle operation of said paper table lever to move said paper table lever down to a standby position, then to move said paper table lever up to a sheet feeding position, and sets the fixing means, which is provided for an empty paper table, to the on-state to fix said empty paper table at a lower position during the process of one cycle.

14. The collating device according to claim 7, further comprising:

a paper table cam which moves said paper table lever up and down during a one cycle operation.

15. The collating device according to claim 14, further comprising;

a stopper lever which is connected with each stopper; and a stopper cam which moves said stopper lever up and down during the one cycle operation.

16. The collating device according to claim 15, wherein said suction head moving means comprises a suction head rotation shaft;

a suction head rod of which ne end is connected to said suction head rotation shaft and another end is connected to said suction head;

a suction head lever for support all suction heads; and a suction head cam which moves said suction head lever up and down during the one cycle operation.

17. The collating device according to claim 16, wherein said nip roller moving means comprises;

a nip rotation shaft provided for each of said nip rollers;

two nip roller rods fixed to each said nip roller rotation shaft at respective one ends, a first of said two nip roller rods connected to said nip roller at another end thereof;

a weight member attached to another end of a second of said two nip roller rods;

a nip roller lever which supports all of said weight members for said nip rollers; and a nip roller cam which moves said nip roller lever up and down during the one cycle operation.

18. The collating device according to claim 17, further comprising;

a chain connecting said stopper cam, suction head cam and nip roller cam; and a motor driving said chain so as to synchronize the rotations of each of said stopper cam, said suction head cam and said nip roller cam.

* * * * *